US007403117B2

(12) United States Patent
Leyden et al.

(10) Patent No.: US 7,403,117 B2
(45) Date of Patent: Jul. 22, 2008

(54) SECURITY SYSTEM WITH TRIGGERED RESPONSE ASSEMBLY

(75) Inventors: Roger Leyden, Inverness, IL (US); Terrance Surma, Bloomingdale, IL (US); Kris Michael Southerland, Palatine, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 196 days.

(21) Appl. No.: 11/112,386

(22) Filed: Apr. 22, 2005

(65) Prior Publication Data

US 2006/0238342 A1 Oct. 26, 2006

(51) Int. Cl.
*G08B 13/12* (2006.01)

(52) U.S. Cl. ..... 340/568.2; 348/150

(58) Field of Classification Search ..... 340/568.2, 340/548, 668; 348/143, 150, 152
See application file for complete search history.

(56) References Cited

U.S. PATENT DOCUMENTS

| | | | | | |
|---|---|---|---|---|---|
| 3,407,400 | A * | 10/1968 | Lurie | ..... | 340/568.2 |
| 3,643,250 | A * | 2/1972 | Sander | ..... | 340/568.2 |
| 3,766,540 | A * | 10/1973 | Schopfer et al. | ..... | 340/568.2 |
| 4,654,640 | A * | 3/1987 | Carll et al. | ..... | 340/568.2 |
| 5,034,723 | A * | 7/1991 | Maman | ..... | 340/568.2 |
| 5,066,942 | A * | 11/1991 | Matsuo | ..... | 340/568.2 |
| 5,124,685 | A * | 6/1992 | Rankin | ..... | 340/568.2 |
| 5,552,771 | A * | 9/1996 | Leyden et al. | ..... | 340/568.2 |
| 6,215,396 | B1 * | 4/2001 | Script | ..... | 340/545.1 |
| 7,053,774 | B2 * | 5/2006 | Sedon et al. | ..... | 340/568.2 |
| 2003/0151510 | A1 * | 8/2003 | Quintana et al. | ..... | 340/568.2 |
| 2004/0150524 | A1 * | 8/2004 | Bonato | ..... | 340/568.2 |

* cited by examiner

*Primary Examiner*—Thomas Mullen
(74) *Attorney, Agent, or Firm*—Wood, Phillips, Katz, Clark & Mortimer

(57) ABSTRACT

The combination of a portable article and a security system. The security system includes a tether having a length. The tether is attached to the portable article and a support so that the portable article is movable relative to the support and confined in movement relative to the support by the tether within a range dictated by the length of the tether. The security system further includes a security response assembly that is triggered as an incident of the portable article being repositioned with the tether attached to the portable article.

30 Claims, 4 Drawing Sheets

SECURITY SYSTEM WITH TRIGGERED RESPONSE ASSEMBLY

BACKGROUND OF THE INVENTION

1. Field of the Invention

This invention relates to security systems for portable articles and, more particularly, to a security system that has a response assembly that is triggered through the repositioning of an object that is being monitored.

2. Background Art

The proliferation of portable consumer electronic articles has presented an ongoing challenge to those in the security industry. Myriad products are currently offered and continue to be developed in communications, data management, music playing, etc. The product displays in establishments that offer these products continue to grow in size. In the highly competitive electronics industry, marketing has dictated a "hands on" method of offering the products to end users. Consumers have in recent years become accustomed to going into "mega-" electronics stores and literally having at their finger tips most existing electronic products. The sheer volume of electronic products now displayed in a typical store, by itself, presents a challenge for those responsible for security. In any one store, many hundreds of these products may be simultaneously displayed for handling and operation by consumers. At peak hours, and particularly during high volume buying seasons, the challenge of employees and security personnel to prevent theft becomes daunting.

The electronics industry continues to offer a range of products with different price tags and capabilities to the retail stores for presentation and sale to end users. Individual displays commonly have these products tethered to a support. In the simplest state, the tethers are mechanical cables which have a somewhat limited capability. Electronic systems offer a higher level of security but involve a more significant financial investment on the part of the store owner. With the large volume of items that are displayed, and tethers having a substantial length to allow convenient inspection by a potential purchaser, wire management problems arise.

The assignee herein developed, and has successfully commercially sold, a product that addresses a number of the problems discussed above. More specifically, this product is shown in U.S. Pat. No. Re. 37,590. This product affords an electronic monitoring capability while addressing wire management problems by retracting a tether/conductive cord into a coiled state in a housing. The product being monitored is operatively engaged with the system by using any of a number of different connectors at the end of the conductive element. A reel is normally spring-biased in one rotational direction to retrieve the conductive element into the housing and, in so doing, draw the associated article that is being monitored towards the housing into a display position. By grasping the article and exerting a force thereon, the conductive cord can be withdrawn from the housing against the spring bias force exerted on the reel.

While the above-described product has been highly commercially successful, it has one limitation that is inherent, not to its design, but rather to the high volume of products displayed at point of purchase. Typically, this type of system has an associated alarm that is activated in the event that the conductive cord is severed and/or the connector is separated from the article that is being monitored. This alarm in many system setups is the primary alert to the fact that there has been a breach. Unfortunately, in large operations, even if the system is properly set up and the alarm triggered during a breach, it may still be possible for the individual causing the breach to abscond with the article, particularly in a crowd, without being identified. This problem is aggravated by the fact that often these systems are not properly set up by personnel, as a result of which false alarms may be triggered. This may cause employees and security personnel to either ignore the signals or shut the systems down to avoid annoyance to existing potential consumers.

Thus, to provide greater security, it would be desirable to have some type of backup that complements the above-described security system. For example, video cameras may allow real time monitoring or monitoring at the conclusion of a predetermined time period, such as at the conclusion of the business day. The difficulty with monitoring using cameras is that a person or persons assigned to do the monitoring must keep track of potentially hundreds of these different security systems over a substantial areal region within the establishment. Even in a crowded commercial establishment with hundreds of displayed items, at any one time, there may be only a limited number of the articles that are actually being physically handled by potential consumers. However, in spite of this, security personnel are required to observe all of the articles, even though they are not being handled and in any immediate danger of being taken without authorization. As a result, this conventional backup security monitoring approach may be difficult to use and impractical, particularly when crowds of potential consumers are present.

As the electronics industry evolves, the products become increasingly smaller, yet with more capabilities, and more expensive. At the same time, the level of sophistication of thieves continues to rise. Accordingly, business establishments are facing an ever increasing challenge in terms of implementing security systems and controlling costs. The value of a security system must be evaluated factoring in its initial cost, its maintenance, and cost of personnel involved in setting up and monitoring, as well as its overall effectiveness. The industry continues to seek out more effective ways of monitoring portable consumer articles through systems that are financially feasible when evaluated in terms of their effectiveness.

SUMMARY OF THE INVENTION

In one form, the invention is directed to the combination of a portable article and a security system. The security system includes a tether having a length. The tether is attached to the portable article and a support so that the portable article is movable relative to the support and confined in movement relative to the support by the tether within a range dictated by the length of the tether. The security system further includes a security response assembly that is triggered as an incident of the portable article being repositioned with the tether attached to the portable article.

In one form, the tether is in the form of a flexible cord.

The security system may further include a reel for the flexible cord. The reel is rotatable in one direction to cause the flexible cord to be wrapped around the reel to draw the article towards a display position and oppositely to the one direction to allow the flexible cord to pay off of the reel. The reel is normally biased towards rotation in the one direction.

The security response assembly may be triggered as an incident of the flexible cord being paid off of the reel.

In one form, the security response assembly includes a camera.

The security system may include a signal generator.

In one form, the signal generator provides a detectable indication as to at least one of a) a location of the security system; and b) an identification of the portable article, as an incident of the security response assembly being triggered.

The support may include a housing within which the flexible cord can be stored.

In one form, the security system includes an alarm signal generator and a connector through which the flexible cord is attached to the portable article. The flexible cord has at least one electrical conductor that is part of a detection circuit that is changed to a breached state as an incident of either a) the connector being separated from the portable article or b) the flexible cord being severed. The alarm signal generator is caused to generate an alarm signal as an incident of the detection circuit being changed to the breached state.

The security system may include a switch that is actuated to trigger the security response assembly.

In one form, the camera is caused to be directed so as to produce images of a location at which the security system resides as an incident of the security response assembly being triggered.

Alternatively, the camera may be caused to be operated as an incident of the security response assembly being triggered.

In one form, the security response assembly includes a recorder for images generated by the camera.

The invention is further directed to a security system having a tether with a length and attachable to a portable article and a support so that a portable article to which the tether is attached is movable relative to the support within a range dictated by the length of the tether. The security system further includes a security response assembly that is triggered as an incident of a portable article to which the tether is attached being repositioned.

The security system may include a housing, with the tether having a flexible cord that can be selectively retracted into and drawn from within the housing.

The security response assembly may include a camera.

The security response assembly may include a signal generator that provides a detectable indication as to at least one of a) a location of the security system; and b) an identification of the portable article, as an incident of the security response assembly being triggered.

The invention is further directed to the combination of a reel that is rotatable around an axis, a flexible cord attached to the reel, a portable article to which the flexible cord is operatively attached, and a response assembly. The flexible cord is attached to the reel so that a) as the reel is rotated in one direction around the axis, the flexible cord is wrapped around the reel; and b) the flexible cord can be drawn off of the reel by exerting a force on the flexible cord that rotates the reel oppositely to the one direction around the axis. The response assembly is triggered as an incident of the flexible cord being drawn off of the reel to cause the performance of a function related to the portable article.

In one form, the switch has first and second states. The switch changes from the first state into the second state as an incident of the flexible cord being drawn off of the reel to thereby trigger the response assembly.

In one form, an actuating assembly is provided on the reel and causes the switch to be changed from the first state into the second state as the flexible cord is drawn off the spool.

The actuating assembly may include a spring with a projecting arm that engages a part of the switch to change the switch from the first state into the second state as the flexible cord is drawn off of the reel.

The spring may be made at least partially from a coiled wire.

In one form, the switch has an element that is engaged by the actuating assembly and deflected from a first position into a second position as an incident of the flexible cord being drawn off of the spool to thereby cause the switch to be changed from the first state into the second state.

The combination may further include a housing within which the reel is located. The switch may be mounted on the housing.

The above-noted function may be a security function.

The function may be a presentation of information related to the portable article.

The invention is further directed to a method of monitoring a portable article. The method includes the steps of: attaching a tether to the portable article; providing a security response assembly; and triggering the security response assembly as an incident of the portable article with the tether attached thereto being repositioned, to thereby cause the security response assembly to cause the generation of a signal that can be processed to identify information concerning at least one of a) a location of the portable article; and b) an identification of the portable article.

The information concerning the location may be an image of the location or a description of the location.

The method may further include the step of intaking the information at a station remote from the location.

The method may further include the steps of monitoring portable articles in the same manner at a plurality of different store locations and intaking the information from the different store locations at the station.

DETAILED DESCRIPTION OF THE DRAWINGS

Figure 1:
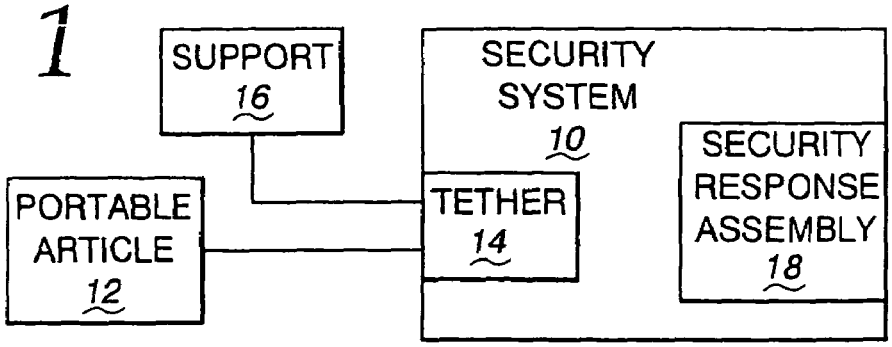
FIG. 1 is a schematic representation of a security system, according to the present invention, and including a tether attached to a portable article, and a security response assembly.

In FIG. 1, a security system, according to the present invention, is shown at 10 in association with a portable article 12, which is monitored through the security system 10. The nature of the portable article 12 is not critical to the present invention. The invention lends itself to use with small articles, such as small electronic goods, which are displayed for user handling in retail establishments. The portable article 12 can be any article that is repositionable by a would-be thief and is not limited to electronic technology.

The security system 10 consists of a tether 14 having a length and operatively attached to the portable article 12 and a support 16 in such a manner that the tethered, portable article 12 is movable relative to the support 16 and confined in movement relative to the support 16 by the tether 14 within a range dictated by the length of the tether 14.

The security system 10 further includes a security response assembly 18 that is triggered as an incident of the portable article 12 being repositioned with the tether 14 attached to the portable article 12.

The nature of the tether 14 may vary considerably. The tether 14 may be a substantially rigid element, an articulated element, a series of joined elements, or a flexible element, consisting of one or more elongate components, as described hereinbelow, or another form that may be arrived at by one skilled in this art.

The security response assembly 18 likewise can take any of a multitude of different forms. In a generic sense, the security response assembly 18 may be designed to either produce an image of the location of the portable article 12 or cause the generation of a signal that can be processed to identify information concerning at least one of a) the location of the portable article 12 and b) an identification of the portable article 12, which may be general or specific. The system 10 may be pre-programmed with the information relative to the location and/or identity of the article 12 to be monitored, or processing may occur each time the security response assembly 18 is triggered to generate this information.

Figure 2:
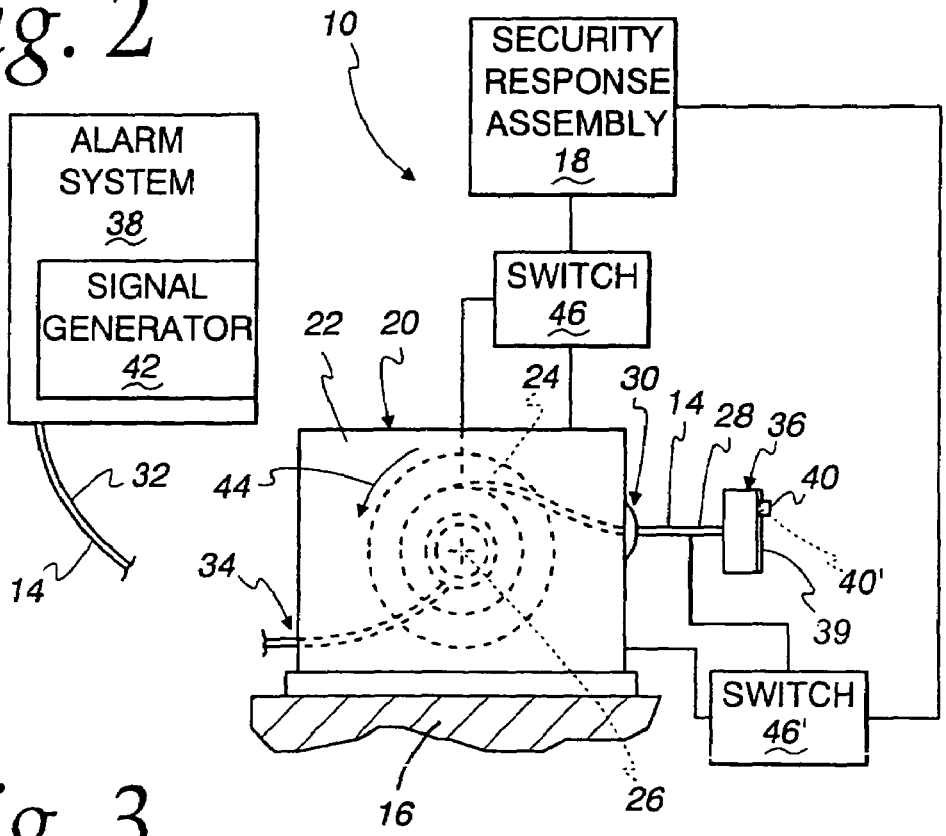
FIG. 2 is a partially schematic representation of one form of security system, according to the invention as seen in FIG. 1, and including a tether that is retractable within a housing, and also including an alarm system for generating a signal in the event that there is a security breach.

One exemplary form of the security system 10 is shown in FIG. 2. The security system 10 incorporates a mechanism at 20, of the type shown in U.S. Pat. No. Re. 37,590, the disclosure of which is incorporated herein by reference.

Briefly, the mechanism 20 includes a housing 22. Within the housing 22 a reel 24 is mounted for rotation around an axis 26. The reel 24 accommodates the tether 14, which in this embodiment is in the form of a flexible cord. A first length 28 of the flexible cord 14 projects from the housing 22 at a first location 30. A second length 32 of the flexible cord 14 projects from the housing 22 at a second location 34, spaced from the first location 30. The cord lengths 28, 32 define a continuous conductive path between an article connector 36 and an alarm system 38. The conductive path defined by the flexible cord 14 is part of a detection circuit that has at least two states; armed and breached.

The connector 36 is operatively attached to the portable article 12, as through the use of an adhesive layer 39, or otherwise by means known to those skilled in the art. By applying the article connector 36 through the layer 39, a plunger 40 is caused to be depressed from the solid line position in FIG. 2 into the dotted line position, whereupon the detection circuit is placed in the armed state. If the flexible cord 14 is severed, or the connector 36 is separated from the article 12, the detection circuit is changed into the breached state, whereupon a signal generator 42, associated with the alarm system 38, is caused to generate a detectable signal to alert the system operator, or individual or individuals monitoring the system 10, of the breach.

According to the invention, the security response assembly 18 is triggered as an incident of the article 12, to which the connector 36 is attached, being repositioned relative to the support 16 to which the housing 22 is attached without being structurally altered, to produce a first detectable response that does not occur in the event that the tether is severed. Normally, the reel 24 is biased in rotation around the axis 26 in the direction of the arrow 44. This causes the first length 28 of the flexible cord 14 to wrap around the reel 24 so as to be stored within the housing 22. A rotative biasing force on the reel 24 may be produced by a spring, as disclosed in U.S. Pat. No. 37,590.

By drawing from left to right on the first length 28 of the flexible cord 14, the reel 24 is rotated oppositely to the direction indicated by the arrow 44 around the axis 26, to thereby allow the flexible cord 14 to pay off of the reel 24. This construction allows a potential purchaser to grasp the article 12 to which the connector 36 is operatively attached and draw the article 12 away from the housing 22 to a range dictated by the length of the flexible cord 14, and more particularly, the first length 28 thereof. In this embodiment, the security response assembly 18 is triggered through one of two switches 46, 46'. The switch 46 acts between the housing 22 and reel 24 and is changed from a first state into a second state to trigger the response assembly 18 as an incident of the reel 24 rotating about the axis 26 oppositely to the direction indicated by the arrow 44. This rotation is indicative of the fact that an article 12 to which the connector 36 is operatively attached is being manipulated by a potential consumer. The switch 46' functions in the same manner and acts between the flexible cord 14 and the housing 22. This could be accomplished in any of virtually an unlimited number of different manners by those skilled in this art.

Figure 3:
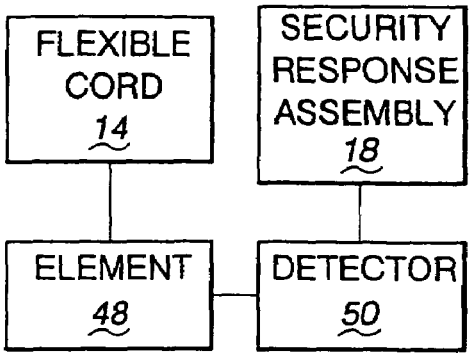
FIG. 3 is a schematic representation of one structure for detecting withdrawal of the tether from the housing in FIG. 2 and including an element on the tether that can be detected as it is withdrawn from the housing.

As just one example, the switches 46, 46' could be switches with manually repositionable actuating elements. Alternatively, as shown in FIG. 3, an element 48 can be provided on the flexible cord 14 that is capable of being sensed by a detector 50. The element 48 and detector 50 can be strategically located so that the detector 50 will sense that the first cord length 28 is being withdrawn, whereupon the detector 50 causes the triggering of the security response assembly 18. Again, these variations are only exemplary of those contemplated by the invention. A further, and preferred, form of this structure is described in detail hereinbelow.

Figure 4:
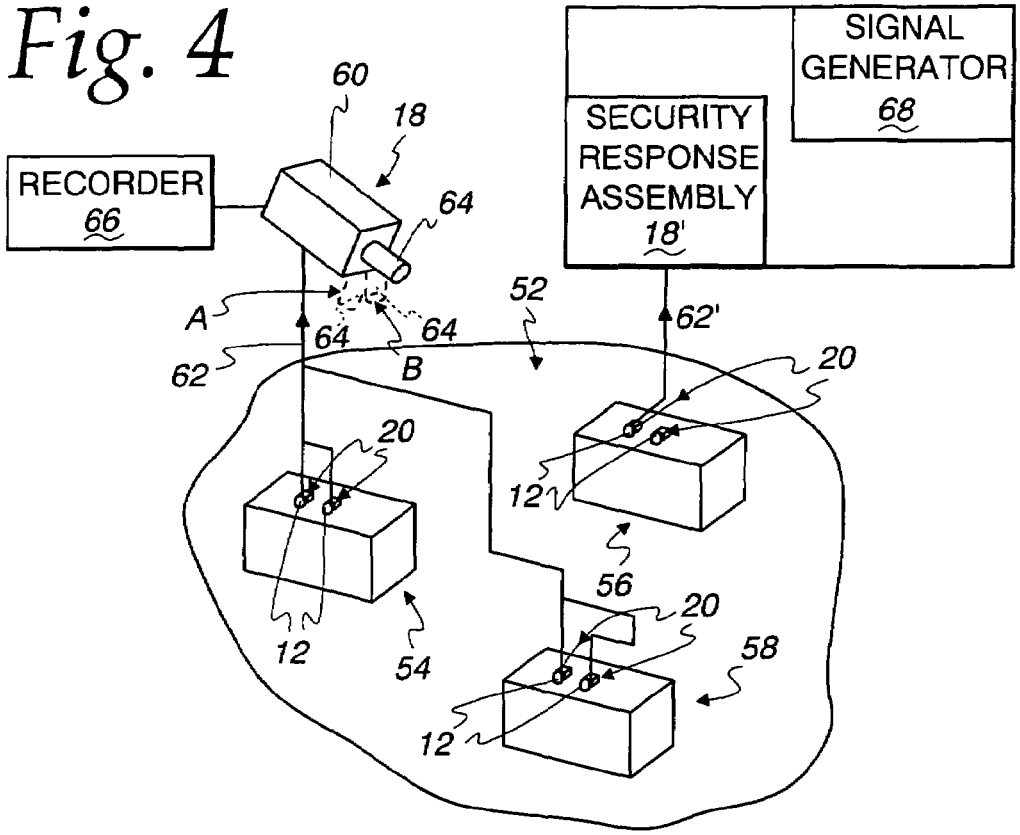
FIG. 4 is a partially schematic, fragmentary, perspective view of a site at which several display setups are provided, each of which has an associated mechanism as in FIG. 2, and including two different forms of security response assembly.

An example of the security response assembly 18 is depicted in FIG. 4 with respect to a display area at 52, with three discrete display setups at 54, 56, 58 at three spaced locations therewithin. At each display setup, two of the mechanisms 20 are shown with an associated portable article 12 operatively attached, one each thereto, through the connectors 36.

The security response assembly 18 is shown, including a camera 60 that is operatively associated with the mechanisms 20, on two of the display setups 54, 58. The camera 60 can be likewise operatively associated with the mechanisms 20 on the display setup 56. In response to the movement of any of the articles 12 relative to their associated mechanism 20 on the display setups 54, 58, a signal at 62 is generated to trigger a specific function of the camera 60. The nature of the function can vary from a security function, as will now be described, to a non-security function, as described further on in the description herein.

As one example, the camera 60 may have a lens 64 with a wide angle capability to focus on the locations of both of the display setups 54, 58. In response to the signal 62, the camera 60 can be changed from a non-operating state into an operating state. In the latter state, the camera 60 produces images of the locations of the setups 54, 58. This image can be conveyed to any appropriate location for inspection.

As an alternative, the signal 62 may be specific to the display setups 54, 58. That is, in response to the signal 62 being generated from the mechanisms 20 on the display setup 54, the camera 60 may move, or otherwise be adjusted, so that the lens 64 is directed, as shown at A in dotted lines, to produce images of the display setup 54, potentially to the exclusion of the display setup 58. Generation of the signal 62 from the mechanisms 20 on the display setup 58 causes the camera 62 to move/adjust so that the lens 64 assumes the position at B, wherein it focuses on the display setup at 58, potentially to the exclusion of the display setup 54.

The images produced through the camera 60 may be viewed on site or at a remote location. This viewing may occur in real time. Alternatively, a recorder 66 may be used to save the images for later review.

The recorder 66 can be programmed to continuously record once the signal 62 is processed. Alternatively, the recorder 66 may record for a prescribed time period and thereafter shut off or go into a standby mode.

Of course, multiple cameras can be used to operate individually or coordinatingly with each other.

FIG. 4 shows an alternative form of the security response assembly at 18'. In response to a signal 62' from either of the exemplary mechanisms 20 at the display setup 56, operation of the security response assembly 18' is triggered. This triggering causes the security response assembly 18' to produce a signal through a generator 68. Through the signal a detectable indication is given as to at least one of a) the location of the security system/display setup 56; and b) an identification of the portable article(s) 12. A signal from the generator 68 may be received on-site or at a remote location. At the location at which the signal is received, the operator can either read, or convert the signal to read, any of virtually unlimited types of information that may be conveyed. The information may be the location of a particular store, as well as the location within that store of the display setup 56. The information may identify the portable article 12 at the display setup 56 in a general sense, or specifically by its type, or even more specifically by a model number or other identification. This facilitates tracking of the article 12, potentially to allow its recovery.

The system may be pre-programmed to include all of the information relative to the setup 56 and the articles 12 thereat. For example, bar code technology can be used on the products 12 to allow scanning thereof at the time the articles 12 are placed at the setup 56 and operatively associated with the connectors 36.

With this arrangement, an individual monitoring the display area 52, either on-site or from a remote location, can be alerted to the fact that a potential purchaser or thief has picked up a specific article 12. This allows the operator to focus on that particular article 12 as opposed to trying to scan the entire area 52 and all display setups 54, 56, 58 thereat. In the event that a breach occurs, the location thereof, and the person thereat, can be focused upon. Additionally, in the event that an article 12 is absconded with, the information may be conveyed, through images, or otherwise, and used to potentially identify the individual(s) taking the article and/or the specific article taken.

Figure 5:
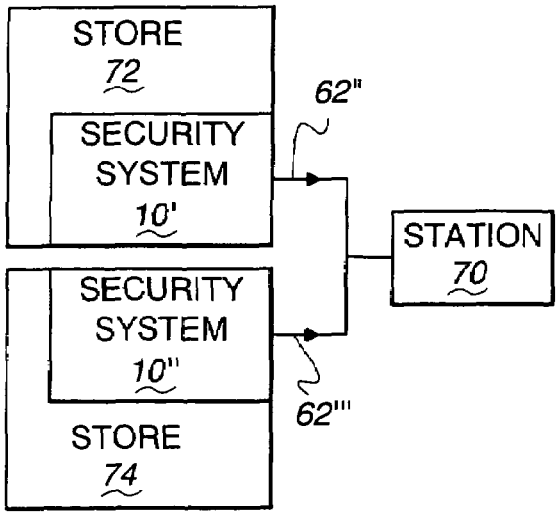
FIG. 5 is a schematic representation of an integrated arrangement of security systems, according to the present invention, with the security systems at different sites.

The invention contemplates monitoring at a single site or coordinatingly monitoring several sites. For example, as shown in FIG. 5, a central station 70 is used to monitor stores 72, 74, at separate locations. The security systems 10', 10" at these locations will generate signals 62", 62'" that can be processed by the personnel at the station 70 in either real time or after the monitored events occur.

Figure 6:
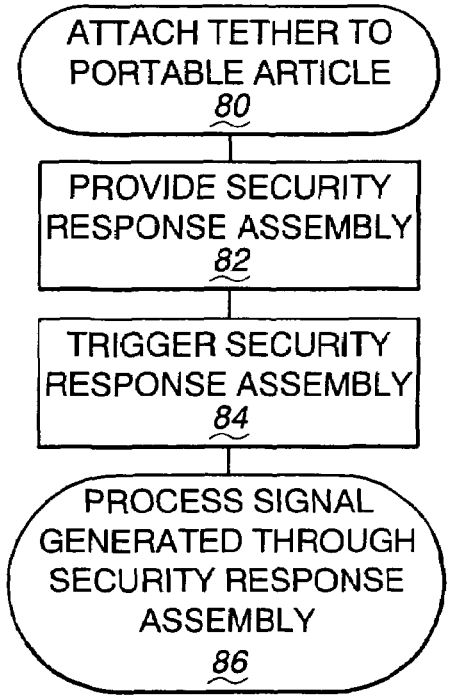
FIG. 6 is a flow diagram representation of one method of monitoring a portable article, according to the present invention.
Figure 7:
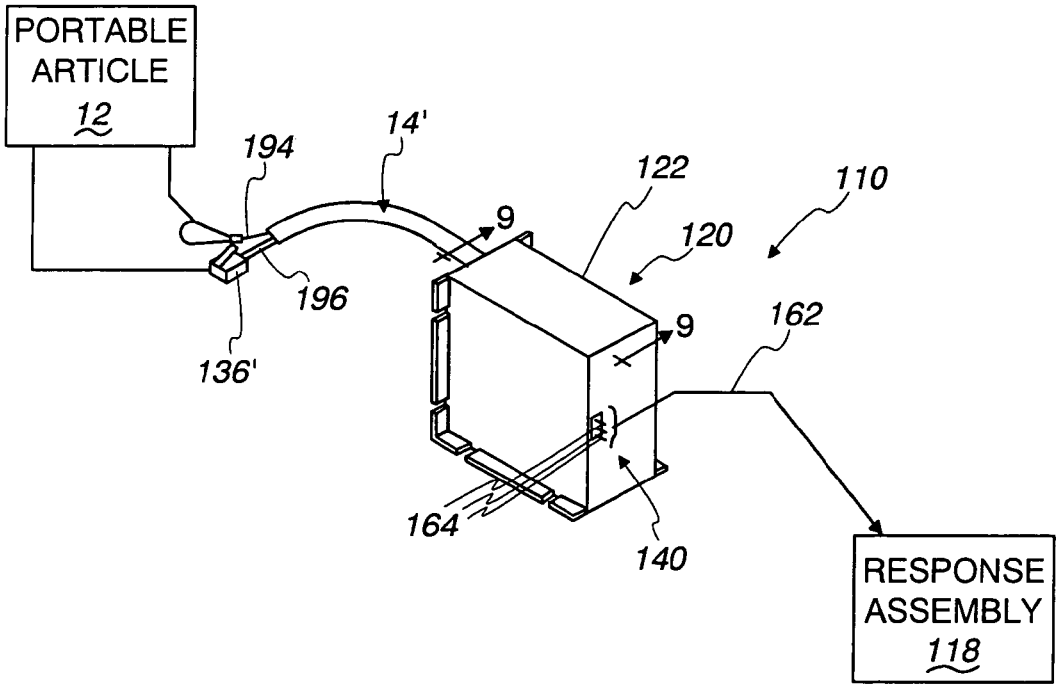
FIG. 7 is a partially schematic representation of a system, according to the present invention, including a tether attached to a portable article and a response assembly, wherein the tether is retractable within a housing, with the housing shown in perspective.
Figure 8:
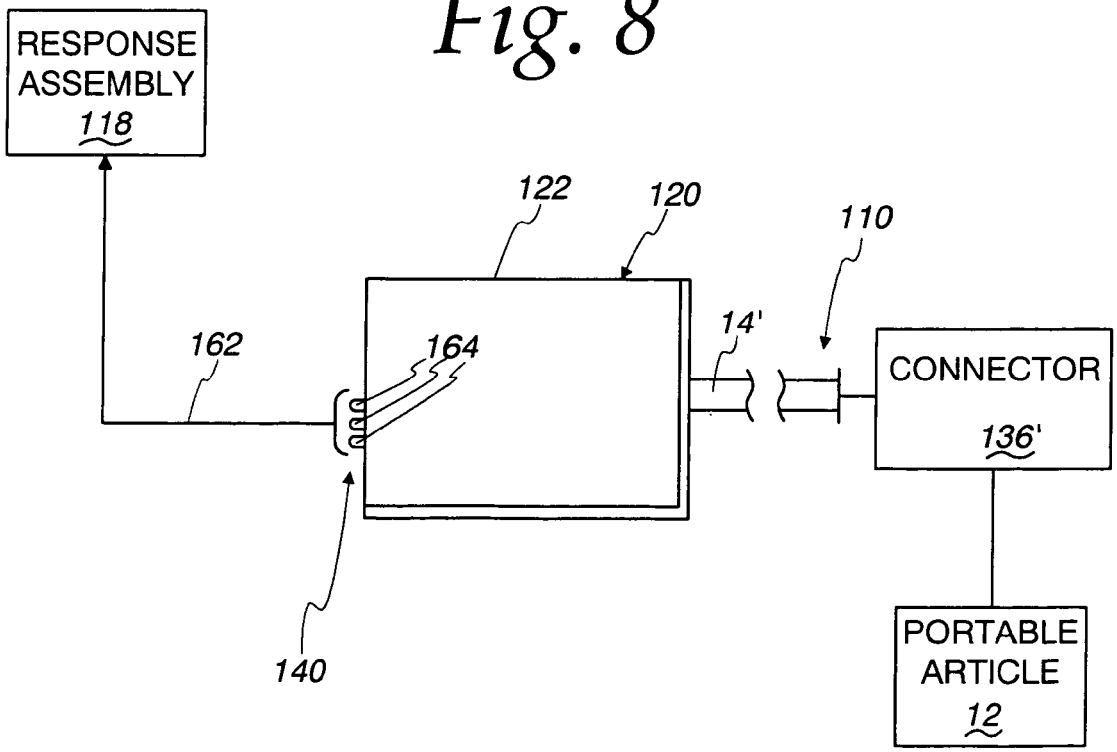
FIG. 8 is a view corresponding to that in FIG. 7 with the housing shown in side elevation.

A method of utilizing the systems 10, 10', 10", hereinabove described, will now be explained with respect to the flow diagram in FIG. 6. This method pertains likewise to systems as hereinbelow described. A tether is attached to a portable article, as shown at block 80. A security response assembly is provided as shown at block 82. The security response assembly may take any form, as described above, or any other form known to those skilled in the art and capable of conveying meaningful information regarding the state of a security system and/or an article. As shown at block 84, as an incident of the portable article, with the tether attached thereto, being repositioned, the security response assembly is triggered, as shown at block 84. This produces a signal that is processed as shown at block 86 to thereby identify information concerning at least one of a) the location of the portable article that has been repositioned; and b) information relating to the identification of that portable article.

With the inventive system, on-site and/or remote monitoring of articles being handled is facilitated. While in FIG. 2, the inventive system 10 is shown as potentially redundant to a conventional system as shown in U.S. Pat. No. Re. 37,590, the conventional system need not be used. That is, in FIG. 2, the alarm generation capability associated with the alarm system 38 can be eliminated altogether, whereby security relies upon the information caused to be generated through the security response assembly 18.

In FIGS. 7-11, a system 110, corresponding to the systems 10', 10", is shown with a response assembly 118 that, in addition to being capable of causing the performance of a function related to security, is additionally, or alternatively, capable of performing a function more generally related to the portable article 12.

The security system includes a mechanism 120, similar to the mechanism 20, to include a housing 122 within which a reel 124 is mounted for rotation around an axis 126. The reel 124 is normally biased towards rotation around the axis in the direction of the arrow 128, whereby the flexible cord 14', projecting from the housing 122 and joined to the portable article 12 through a connector 136', is wrapped around the reel 124 to draw the flexible cord 14' into the housing 122 to place the portable article 12 in a display position therefor.

The housing 122 supports a switch 140 that has first and second states. The switch 140 has a deflectable element 142 that is cantilever mounted with respect to a housing 144. The element 142 is movable between a first position, shown in solid lines in FIG. 11, and a second position, shown in dotted lines in that same figure, by deflection in the direction of the arrow 145. As an incident of changing between the first and second positions, the element 142 causes the switch 140 to change from a first state into a second state therefor. As this occurs, a signal 162 is generated to the response assembly 118 to effect triggering thereof. The details of the switch 140 are not critical to the present invention. In the embodiment shown, the switch 140 has exposed contacts 164 for connection to a cord through which the triggering signal 162 is transmitted as the state of the switch 140 is changed.

The switch state is caused to be changed through an actuating assembly at 170. The actuating assembly 170 consists of a spring wire 172 with a coiled center 174 that surrounds a hub 176 on the reel 124. The spring wire 172 may be one continuous element or defined by multiple pieces. In the continuous construction, a plurality of coils 178 define the center 174. One coil 178 extends to an elongate arm 180 with an offset end 182. Another coil 178 extends to an elongate arm 184, projecting diametrically oppositely to the direction of the projection of the arm 180, and terminates at an offset end 186.

Figure 9:
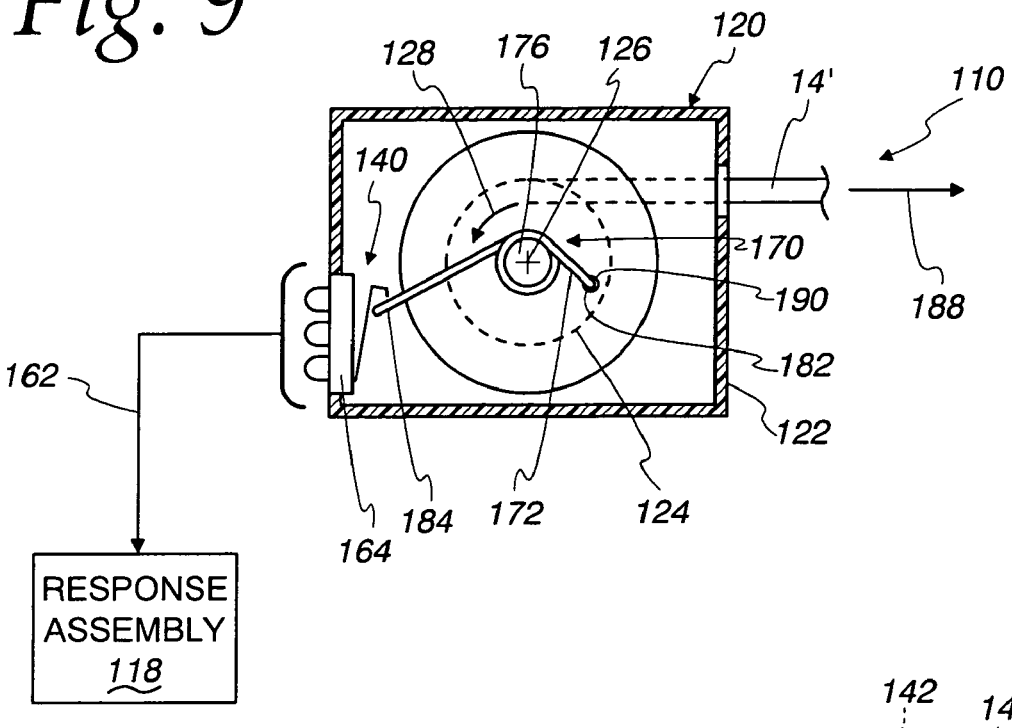
FIG. 9 is a view as in FIGS. 7 and 8 showing a cross-sectional view of the housing taken along lines 9-9 of FIG. 7.
Figure 11:
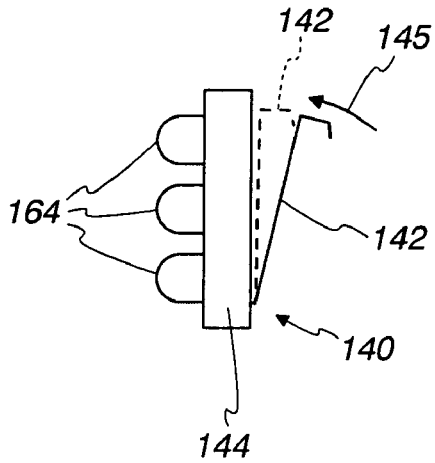
FIG. 11 is an enlarged, elevation view of the switch in FIG. 9, with an element thereon that is repositioned to change the state of the switch.
Figure 10:
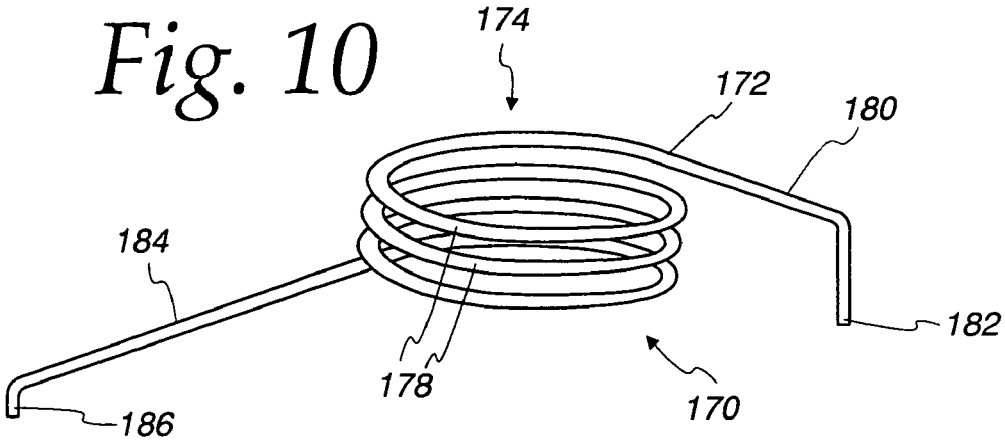
FIG. 10 is an enlarged, perspective view of an actuating element for causing a switch on the housing to be operated as an incident of a reel, to which the flexible cord is attached, being rotated.

FIG. 9 shows the reel 124 rotated so as to place the portable article 12 operatively attached to the system 110 in a display position. By drawing on the flexible cord 14' in the direction of the arrow 188, the flexible cord 14' is paid off of the reel 124. As this occurs, the reel 124 rotates oppositely to the direction of the arrow 128 around the axis 126. With the arm end 182 directed into a receptacle 190 on the reel 124, the actuating assembly 170 will follow rotation of the reel 124. As this occurs, the arm 184 moves from the FIG. 9 position into contact with the deflectable element 142. Continued rotation of the reel 124 causes the arm 184 to reposition the element 142 from the first position into the second position therefor, thereby triggering operation of the response assembly 118. Continued rotation of the reel 124 causes the coils 178 to radially constrict, while the arm 184 is maintained in contact with the element 142 and bears the same into the second position therefor. Accordingly, the actuating assembly 170 maintains the switch in its second state throughout a range of rotational movement of the reel 124 as the flexible cord 14' is being withdrawn, through manipulation of the portable article 12.

Once the withdrawing force on the flexible cord 14' is released, the reel 124 is urged in rotation around the axis 126 in the direction of the arrow 128. As this occurs, the coils 178 are allowed to radially expand towards their undeformed state while still maintaining the arm 184 borne against the element 142 in the second position therefor. Eventually, the arm 184 will be repositioned so as to allow movement of the element 142 back into its first position.

The system may be designed, through selection of the configuration of the actuating assembly 170 and the cooperating reel 124, so that the switch 140 is placed and maintained in its second position through a selected range of several inches of movement of the flexible cord 14'. The switch 140 will thus remain in the second position as the flexible cord 14' is withdrawn and retracted through this range.

While the response assembly 118 can cause the performance of the security functions, previously described, it is contemplated that the response assembly 118 can cause the performance of a more general function, related directly or indirectly to the portable article 12. In this respect, the function is essentially unlimited in terms of its nature. As just one example, the portable article 12 may be a camera. Triggering of the response assembly 118 may cause the activation of a monitor through a link from the camera so that photographic images produced by the camera can be visually observed. As a further example, the response assembly 118 may cause the activation of a light, or other signal, that either alerts an individual having a security monitoring function that the article 12 is being handled, or alerts a salesman to a potential customer that should be attended to. As a further example, the response assembly 118 may cause the playing of a video that is for educational, instructional, or entertainment purposes. As noted above, the nature of the function that is performed is not limited to those described above, but may be virtually any function associated with security, advertisement, entertainment, etc. The mechanisms described in FIGS. 1-6 may also be utilized to cause the performance of a non-security function in this same manner.

The flexible cord 14' differs from the flexible cord 14 additionally by reason of there being an elongate, high strength, mechanical element 194 that can be used to connect between the housing 122 and portable article 12 and perform a backup security function in conjunction with a conductive element 196 that is used to generate an electrical signal. The connector 136' on the end of the conductive element 196 is shown in the form of a phone jack to facilitate operative connection of the flexible cord 14' to the portable article 12.

The foregoing disclosure of specific embodiments is intended to be illustrative of the broad concepts comprehended by the invention.

The invention claimed is:

1. In combination:

a) a portable article; and b) a security system comprising:

a tether having a length and attached to the portable article and a support so that the portable article is movable relative to the support and confined in movement relative to the support by the tether within a range dictated by the length of the tether; and a security response assembly that is triggered as an incident of the portable article being repositioned with the tether attached to the portable article to produce a first detectable response that does not occur in the event that the tether is severed, wherein the security response assembly is capable of being triggered with: a) the tether remaining attached at the same time to the portable article and support; and b) the tether structurally unaltered by reason of the portable article being repositioned so that the tether continues to confine movement of the portable article relative to the support.

2. The combination according to claim 1 wherein the tether comprises a flexible cord.

3. The combination according to claim 2 wherein the security system further comprises an alarm signal generator, and a connector through which the flexible cord is attached to the portable article, the flexible cord comprising at least one electrical conductor that is part of a detection circuit that is changed to a breached state as an incident of either a) the connector being separated from the portable article or b) the flexible cord being severed, the alarm signal generator caused to generate a second detectable response in the form of an alarm signal as an incident of the detection circuit being changed to the breached state, the security response assembly capable of being triggered without changing the detection circuit to a breached state.

4. The combination according to claim 1 wherein the security system comprises a signal generator to produce the first detectable response.

5. The combination according to claim 1 wherein the security system comprises a switch that is actuated to trigger the security response assembly.

6. In combination:

a) a portable article; and b) a security system comprising:

a tether having a length and attached to the portable article and a support so that the portable article is movable relative to the support and confined in movement relative to the support by the tether within a range dictated by the length of the tether; and a security response assembly that is triggered as an incident of the portable article being repositioned with the tether attached to the portable article to produce a first detectable response that does not occur in the event the tether is severed, wherein the security response assembly is capable of being triggered with the tether remaining attached at the same time to the portable article and support so that the tether continues to confine movement of the portable article relative to the support, wherein the tether comprises a flexible cord, wherein the security system further comprises a reel for the flexible cord, the reel rotatable in one direction to cause the flexible cord to be wrapped around the reel to draw the article towards a display position and rotatable oppositely to the one direction to allow the flexible cord to pay off of the reel, the reel normally biased towards rotation in the one direction.

7. In combination:

a) a portable article; and b) a security system comprising:

a tether having a length and attached to the portable article and a support so that the portable article is movable relative to the support and confined in movement relative to the support by the tether within a range dictated by the length of the tether; and a security response assembly that is triggered as an incident of the portable article being repositioned with the tether attached to the portable article, wherein the tether comprises a flexible cord, wherein the security system further comprises a reel for the flexible cord, the reel rotatable in one direction to cause the flexible cord to be wrapped around the reel to draw the article towards a display position and rotatable oppositely to the one direction to allow the flexible cord to pay off of the reel, the reel normally biased towards rotation in the one direction, wherein the security response assembly is triggered as an incident of the flexible cord being paid off of the reel.

8. In combination:

a) a portable article; and b) a security system comprising:

a tether having a length and attached to the portable article and a support so that the portable article is movable relative to the support and confined in movement relative to the support by the tether within a range dictated by the length of the tether; and a security response assembly that is triggered as an incident of the portable article being repositioned with the tether attached to the portable article, wherein the security response assembly is capable of being triggered with: a) the tether remaining attached to the portable article and support; and b) the tether structurally unaltered by reason of the portable article being repositioned so that the tether continues to confine movement of the portable article relative to the support.

wherein the security response assembly comprises a camera.

9. The combination according to claim 8 wherein the camera is caused to be directed so as to produce images of a location at which the security system resides as an incident of the security response assembly being triggered.

10. The combination according to claim 8 wherein the camera is caused to be operated as an incident of the security response assembly being triggered.

11. The combination according to claim 8 wherein the security response assembly comprises a recorder for images generated by the camera.

12. In combination:

a) a portable article; and b) a security system comprising:

a tether having a length and attached to the portable article and a support so that the portable article is movable relative to the support and confined in movement relative to the support by the tether within a range dictated by the length of the tether; and a security response assembly that is triggered as an incident of the portable article being repositioned with the tether attached to the portable article, wherein the security response assembly is capable of being triggered with: a) the tether remaining attached to the portable article and support; and b) the tether structurally unaltered by reason of the portable article being repositioned so that the tether continues to confine movement of the portable article relative to the support, wherein the security system comprises a signal generator, wherein the signal generator provides a detectable indication as to at least one of a) a location of the security system, and b) an identification of the portable article as an incident of the security response assembly being triggered.

13. In combination:

a) a portable article; and b) a security system comprising:

a tether having a length and attached to the portable article and a support so that the portable article is movable relative to the support and confined in movement relative to the support by the tether within a range dictated by the length of the tether; and a security response assembly that is triggered as an incident of the portable article being repositioned with the tether attached to the portable article to produce a first detectable response that does not occur in the event that the tether is severed, wherein the security response assembly is capable of being triggered with the tether remaining attached at the same time to the portable article and support so that the tether continues to confine movement of the portable article relative to the support, wherein the tether comprises a flexible cord, wherein the support comprises a housing within which the flexible cord can be stored.

14. A security system comprising:

a tether having a length and attachable to a portable article and a support so that a portable article to which the tether is attached is movable relative to the support within a range dictated by the length of the tether; and a security response assembly that is triggered, as an incident of a portable article to which the tether is attached being repositioned and without requiring affecting how the tether is attached to either the portable article or support to produce a first detectable response that does not occur in the event that the tether is severed, wherein the security response assembly is capable of being triggered with: a) the tether remaining attached at the same time to the portable article and support; and b) the tether structurally unaltered by reason of the portable article being repositioned so that the tether continues to confine movement of the portable article relative to the support.

15. A security system comprising:

a tether having a length and attachable to a portable article and a support so that a portable article to which the tether is attached is movable relative to the support within a range dictated by the length of the tether; and a security response assembly that is triggered as an incident of a portable article to which the tether is attached being repositioned and without requiring affecting how the tether is attached to either the portable article or support to produce a first detectable response that does not occur in the event that the tether is severed, wherein the security response assembly is capable of being triggered with the tether remaining attached at the same time to the portable article and support so that the tether continues to confine movement of the portable article relative to the support, wherein the security system comprises a housing and the tether comprises a flexible cord that can be selectively retracted into and drawn from within the housing.

16. A security system comprising:

a tether having a length and attachable to a portable article and a support so that a portable article to which the tether is attached is movable relative to the support within a range dictated by the length of the tether; and a security response assembly, that is triggered as an incident of a portable article to which the tether is attached being repositioned and without requiring affecting how the tether is attached to either the portable article or support, wherein the security response assembly is capable of being triggered with the tether remaining attached to the portable article and support so that the tether continues to confine movement of the portable article relative to the support, wherein the security system comprises a housing and the tether comprises a flexible cord that can be selectively retracted into and drawn from within the housing, wherein the security response assembly comprises a camera.

17. A security system comprising:

a tether having a length and attachable to a portable article and a support so that a portable article to which the tether is attached is movable relative to the support within a range dictated by the length of the tether; and a security response assembly, that is triggered as an incident of a portable article to which the tether is attached being repositioned and without requiring affecting how the tether is attached to either the portable article or support, wherein the security response assembly is capable of being triggered with the tether remaining attached to the portable article and support so that the tether continues to confine movement of the portable article relative to the support, wherein the security system comprises a housing and the tether comprises a flexible cord that can be selectively retracted into and drawn from within the housing, wherein the security response assembly comprises a signal generator that provides a detectable indication as to at least one of a) a location of the security system; and b) an identification of the portable article as an incident of the security response assembly being triggered.

18. In combination:

a reel that is rotatable around an axis;

a flexible cord attached to the reel so that a) as the reel is rotated in one direction around the axis the flexible cord is wrapped around the reel and b) the flexible cord can be drawn off of the reel by exerting a force on the flexible cord that rotates the reel oppositely to the one direction around the axis;

a portable article to which the flexible cord is operatively attached; and a response assembly that is triggered as an incident of the flexible cord being drawn off of the reel to cause the performance of a function related to the portable article.

19. The combination according to claim 18 further comprising a switch that has first and second states, and the switch changes from the first state into the second state as an incident of the flexible cord being drawn off of the reel to thereby trigger the response assembly.

20. The combination according to claim 19 wherein an actuating assembly is provided in the reel and causes the switch to be changed from the first state into the second state as the flexible cord is drawn off of the reel.

21. The combination according to claim 20 wherein the actuating assembly comprises a spring with a projecting arm that engages a part of the switch to change the switch from the first state into the second state as the flexible cord is drawn off of the reel.

22. The combination according to claim 21 wherein the spring comprises a coiled wire.

23. The combination according to claim 20 wherein the switch has an element that is engaged by the actuating assembly and deflected from a first position into a second position as an incident of the flexible cord being drawn off of the reel to thereby cause the switch to be changed from the first state into the second state.

24. The combination according to claim 19 further comprises a housing within which the reel is located, and the switch is mounted on the housing.

25. The combination according to claim 18 wherein the function comprises a security function.

26. The combination according to claim 18 wherein the function comprises presentation of information related to the portable article.

27. A method of monitoring a portable article, the method comprising the steps of:

attaching a tether to the portable article and to a support;

providing a security response assembly; and triggering the security response assembly as an incident of the portable article with the tether attached thereto being repositioned to thereby cause the security response assembly to cause the generation of a signal that can be processed to identify information concerning at least one of a) a location of the portable article; and b) an identification of the portable article and without requiring affecting how the tether is attached to either the portable article or support, wherein the security response assembly is capable of being triggered with: a) the tether remaining attached to the portable article and support; and b) the tether structurally unaltered by reason of the portable article being repositioned so that the tether continues to confine movement of the portable article relative to the support.

28. The method of monitoring a portable article according to claim 27 wherein the information concerning the location comprises one of an image of the location and a description of the location.

29. The method of monitoring a portable article according to claim 27 further comprising the step of intaking the information at a station remote from the location.

30. The method according to claim 29 further comprising the steps of monitoring portable articles in the same manner at a plurality of different store locations and intaking the information from the different store locations at the station.

* * * * *